US012703019B2

(12) United States Patent
Woidasky et al.

(10) Patent No.: US 12,703,019 B2
(45) Date of Patent: Aug. 11, 2026

(54) BENDING MACHINE, IN PARTICULAR A PRESS BRAKE, WITH A SAFETY SYSTEM

(71) Applicant: BYSTRONIC LASER AG, Niederönz (CH)

(72) Inventors: Lars Woidasky, Gotha (DE); Ronny Wenig, Gotha (DE)

(73) Assignee: BYSTRONIC LASER AG, Niederönz (CH)

( * ) Notice: Subject to any disclaimer, the term of this patent is extended or adjusted under 35 U.S.C. 154(b) by 0 days.

(21) Appl. No.: 18/290,203

(22) PCT Filed: May 11, 2022

(86) PCT No.: PCT/EP2022/062743

§ 371 (c)(1),
(2) Date: Nov. 10, 2023

(87) PCT Pub. No.: WO2022/238461

PCT Pub. Date: Nov. 17, 2022

(65) Prior Publication Data

US 2024/0261838 A1 Aug. 8, 2024

(30) Foreign Application Priority Data

May 12, 2021 (EP) ..... 21173567

(51) Int. Cl.
*B21D 5/02* (2006.01)
*B21D 55/00* (2006.01)

(52) U.S. Cl.
CPC ..... *B21D 5/0209* (2013.01); *B21D 55/00* (2013.01)

(58) Field of Classification Search
CPC ..... B21D 5/0209; B21D 55/00; F16P 3/144
(Continued)

(56) References Cited

U.S. PATENT DOCUMENTS 1,103,867 A * 7/1914 Cooper ..... F16P 3/08 192/133
4,527,684 A * 7/1985 Eggeman ..... F16P 3/16 192/130

(Continued)

FOREIGN PATENT DOCUMENTS

CN 111558666 A 8/2020
EP 0146460 A2 6/1985

(Continued)

OTHER PUBLICATIONS

Machine Langauge Translation of: EP3372319 A2.

(Continued)

*Primary Examiner* — Adam J Eiseman
*Assistant Examiner* — Fred C Hammers
(74) *Attorney, Agent, or Firm* — BelayIP

(57) ABSTRACT

The invention relates to a bending machine, in particular a press brake, having an upper beam and a lower beam. The upper beam is movable in a working direction of the bending machine in order to form a workpiece by bending along a bending line, which extends in a width direction of the bending machine. The bending machine includes a safety system having a first functional element and a further functional element for monitoring a safety area between both functional elements and between the upper beam and the lower beam. The safety system is arranged to follow the movement of the upper beam in the working direction. The first functional element and the further functional element are mechanically connected to one another via a flexible tractive force transmission means and an adjustment device for changing the position of the functional elements. The adjustment device includes a coupling section.

11 Claims, 5 Drawing Sheets

(58) Field of Classification Search
USPC ..... 72/462
See application file for complete search history.

(56) References Cited

U.S. PATENT DOCUMENTS

| | | | | |
|---|---|---|---|---|
| 6,389,860 | B1 * | 5/2002 | Stalzer | B21D 55/00 72/28.1 |
| 2003/0141975 | A1 * | 7/2003 | Hama | G01V 8/20 250/221 |
| 2004/0035178 | A1 * | 2/2004 | Matsumoto | B21D 5/0272 72/389.8 |
| 2004/0074278 | A1 * | 4/2004 | Hayashi | B21D 5/0209 72/481.2 |

FOREIGN PATENT DOCUMENTS

| | | | |
|---|---|---|---|
| EP | 1663542 | | 6/2006 |
| EP | 3372319 | A2 | 9/2018 |
| JP | 2016198818 | A | 12/2016 |

OTHER PUBLICATIONS

Machine Langauge Translation of: CN111558666 A.
Machine Langauge Translation of: JP2016198818 A.
Machine Langauge Translation of:EP1663542.
Machine Langauge Translation of:EP0146460 A2
OEE Workproduct for PPH Request; International Preliminary Report on Patentability for PCT/EP2022/062743, dated Aug. 16, 2023.

* cited by examiner

BENDING MACHINE, IN PARTICULAR A PRESS BRAKE, WITH A SAFETY SYSTEM

CROSS REFERENCE TO RELATED APPLICATION

This application is a national stage of international application PCT/EP2022/062743, filed May 11, 2022, which claims priority to European patent application EP21173567.5, filed May 12, 2021, the content of the both of which is herein incorporated by reference.

BACKGROUND OF THE INVENTION

Field of the Invention

The invention relates to a safety system and a bending machine, in particular a press brake, having a safety system In bending machines, a deformation of a workpiece is achieved by a vertically movable upper beam that presses on the workpiece, which rests on a lower beam located below the upper beam.

It is known from the prior art to provide a safety system consisting of a transmitter and receiver on a bending machine in order to detect the unintentional intrusion of objects or body parts between the upper beam and the lower beam. The transmitter and receiver are positioned at opposite ends laterally under the upper beam and follow the movement of the upper beam. The transmitter emits radiation, such as light, which is detected by the receiver. Due to objects between the transmitter and receiver, less radiation is detected by the receiver. As a consequence, the movement of the upper beam can be stopped.

There is often a need to adjust the vertical height of the transmitter and receiver in the bending machine for such a safety system, e.g., when tools in the bending machine are replaced and this changes the height of the detection area between transmitter and receiver.

Document U.S. Pat. No. 4,527,684 A discloses a safety system for a bending machine according to the preamble of claim 1.

In the publication EP 3 372 319 A2 a safety system for a bending machine is described, in which the transmitter and the receiver are separately connected to a respective flexible retaining element, which is guided over an adjusting disk. The height of the respective transmitter and receiver can be adjusted via the adjusting disk. This safety system has the disadvantage that separate mechanics are required for the transmitter and receiver to adjust their height.

The publication CN 111558666 A discloses a safety system for a bending machine in which a synchronous height adjustment of a transmitter and a receiver is achieved via a complex and bulky linkage arrangement.

The object of the invention is to provide a safety system in a bending machine that has a simply constructed and space-saving adjustment device for adjusting the height of the transmitter and receiver.

This object is achieved by the safety system according to patent claim 1. Further developments of the invention are defined in the dependent claims.

The safety system according to the invention is provided for bending machine, which is in particular a press brake. The interactions between the safety system and the bending machine described below are to be understood in such a way that these interactions occur when the safety system is installed in the bending machine, i.e., when the safety system is used or operated in the bending machine as intended. The safety system or its components are thus configured to cause the corresponding interactions when the safety system is installed in the bending machine.

The bending machine for which the safety system is provided includes an upper beam and a lower beam, wherein the upper beam is movable in a working direction of the bending machine relative to the lower beam in order to form a workpiece, in particular a sheet inserted between the upper beam and the lower beam via a front side of the bending machine, by bending along a bending line, which extends in a width direction of the bending machine. The working direction preferably corresponds to a vertical height direction of the bending machine.

Where in the following terms are used in connection with above or below or in relation to a (vertical) height direction, these terms always refer to the vertical top-bottom direction in the operating position of the bending machine, i.e., the position of its intended use.

The safety system includes a first functional element and a further functional element for monitoring, preferably directly monitoring, a safety area between both functional elements and between the upper beam and the lower beam. Preferably, the first functional element and the further functional element are positioned between the upper beam and the lower beam. Preferably, the first functional element is a transmitter for emitting radiation and the further functional element is a receiver for receiving radiation from the transmitter. The radiation from the transmitter is preferably optical radiation in the visible and possibly also non-visible wavelength range. If necessary, the radiation can also be laser radiation. The safety system is arranged to follow the movement of the upper beam in the working direction. In addition to optically operating functional elements, however, those operating by means of other principles are also conceivable, such as acoustic or ultrasonic sensors, radar sensors, capacitive sensors, etc.

In the safety system according to the invention, the first functional element and the further functional element are mechanically connected to one another via a flexible tractive force transmission means and an adjustment device for changing the position of the functional elements. Preferably, the first functional element and the further functional element are mechanically connected to one another exclusively via the flexible tractive force transmission means and the adjustment device. A flexible tractive force transmission means is a transmission means that is used exclusively for the transmission of tractive force and is deformable or flexible without any tractive force acting on it.

The adjustment device includes a coupling section movably guided in the working direction, which is (mechanically) coupled to the flexible tractive force transmission means in order to convert a movement of the coupling section into a movement of the flexible tractive force transmission means, which causes a path-identical change in position of the functional elements in the working direction relative to the upper beam. Thus, a common coupling section is provided for the first functional element and the further functional element.

The adjustment device is a manual adjustment device by which the movement of the coupling section is effected via a mechanical application of force by an operator. To do so, the adjustment device comprises a tension-proof adjusting element, such as a strap or rope, having a handle (e.g., a grip). This tension-proof adjusting element is connected in the interior of the bending machine to the coupling section located there, wherein the tension-proof adjusting element extends from the interior of the bending machine through a body part of the bending machine to the handle, the handle being accessible from the exterior of the bending machine. Preferably, the coupling section is movable by increasing and decreasing the tractive force which the operator exerts on the tension-proof adjusting element via the handle. Preferably, the handle is magnetic or has a magnetic element so that the handle adheres to the body part of the bending machine, e.g., the front side of the upper beam, by magnetic force.

The safety system according to the invention has the advantage that a synchronous change in position of the two functional elements can be achieved simply and in a space-saving manner by means of a common coupling section for the first functional element and the further functional element in combination with a flexible tractive force transmission means.

Due to the adjustment device comprising a tension-proof adjusting element having a handle, a very space-saving and convenient manual adjustment of the position of the functional elements is achieved. Furthermore, the operator cannot be endangered by this embodiment during machine operation. In the event of a possible collision, the handle detaches from the upper beam and eliminates the risk of crushing.

BRIEF SUMMARY OF THE INVENTION

In a preferred embodiment of the safety system according to the invention, the coupling section and the flexible tractive force transmission means are arranged such that the change in position of the first functional element and the further functional element in the working direction relative to the upper beam is a linear displacement of the first functional element and the further functional element along the working direction. This ensures a space-saving movement of the transmitter and receiver for their position change.

In another preferred embodiment, the flexible tractive force transmission means comprises one or more sections, wherein a first section connects the coupling section to the first functional element and another section connects the coupling section to the further functional element. This creates a particularly simple configuration of the tractive force transmission means. The sections can, for example, be configured as ropes (e.g., wire ropes).

In another preferred embodiment, the flexible tractive force transmission means is guided on the rear side of the upper beam, wherein the rear side faces away from the front side of the bending machine. This ensures that the tractive force transmission means is not located on the operator side of the bending machine, thus avoiding unwanted interference contours and pinch points on the operator side.

In a preferred variant of the embodiment just described, one or more deflection means are provided for guiding the flexible tractive force transmission means, which are arranged on the rear side of the upper beam. Preferably, these deflection means are configured as deflection pulleys. With this variant, a flexible arrangement of the tractive force transmission means on the rear side of the upper beam can be achieved.

In another preferred embodiment, the adjustment device is arranged on the upper beam. For example, the adjustment device can be integrated into the upper beam. Preferably, the coupling section is arranged on the rear side of the upper beam. This allows a compact arrangement of the adjustment device in the bending machine. Nevertheless, it can also be possible to arrange the adjustment device to be laterally offset in the width direction next to the upper beam. In a further embodiment, the adjustment device is covered by a cover so that it is suitably protected during operation of the bending machine.

In a particularly preferred embodiment, the coupling section is linearly movable and preferably movable in the working direction of the bending machine, wherein the linear movement of the coupling section displaces one end of the tractive force transmission means connected to the first functional element offset by the same distance in the working direction as another end of the tractive force transmission means connected to the further functional element. With this embodiment, the change in position of the functional elements is effected in a simple manner via a linear movement of the coupling section.

In another preferred variant, the tension-proof adjusting element is connected to the coupling section located on the rear side of the upper beam, facing away from the front side of the bending machine. The tension-proof adjusting element extends from the rear side of the upper beam through the upper beam and then along the front side of the upper beam opposite the rear side to the handle, wherein the tension-proof adjusting element extends along the front side preferably downward to the handle. The coupling section can be moved by increasing and decreasing the tractive force which the operator exerts on the tension-proof adjusting element via the handle. Preferably, the handle is magnetic or has a magnetic element so that the handle adheres to the front side of the upper beam by magnetic force.

In another preferred embodiment, the manual adjustment device includes locking means that allow the operator to lock the coupling section in a plurality of different positions. The locking means can be released from a locked position by the operator and subsequently locked in a new position by the operator after movement of the coupling section. Depending on the design, the locking can be realised without a grid, e.g., via a clamping mechanism, or it can be designed with a grid, i.e., there is a fixed number of locking positions.

In a preferred variant, the locking means comprises a positioning element, such as a bolt, which can preferably be actuated via the front side of the upper beam, for locking in various defined locking positions of the coupling section. The positioning element is biased into a locking position via a return element. If the positioning element can be actuated via the front side of the upper beam, it preferably does not protrude beyond the front side of the upper beam, thus avoiding interfering contours and pinch points on the front side of the upper beam.

In an embodiment not defined in the claims, instead of a manual adjustment device, an automatic adjustment device can also be provided, which can be actuated by means of an actuator, e.g., hydraulically and/or electromechanically and/or pneumatically. The actuator is preferably controllable by operator actions. This embodiment makes it easier to adjust the position of the functional elements.

In another preferred embodiment, a display means is provided for visualising the position (preferably the height position) of the first functional element and the further functional element in the working direction for an operator. In a simple realisation, the display means is a scale, wherein the position of the functional elements in the working direction is preferably indicated on the scale by an operating element, such as the above handle of the tension-proof adjusting element. Nonetheless, the display means can also include one or more light units or one or more displays.

In addition to the safety system described above, the invention relates to a bending machine which includes an upper beam and a lower beam, wherein the upper beam is movable in a working direction of the bending machine relative to the lower beam in order to form a workpiece inserted between the upper beam and the lower beam via a front side of the bending machine, by bending along a bending line, which extends in a width direction of the bending machine.

The bending machine includes a safety system having a first functional element and a further functional element for monitoring a safety area between both functional elements and between the upper beam and lower beam of the bending machine. The safety system is arranged to follow the movement of the upper beam in the working direction.

In the safety system of the bending machine according to the invention, the first functional element and the further functional element are mechanically connected to one another via a flexible tractive force transmission means and an adjustment device for changing the position of the functional elements, wherein the adjustment device comprises a coupling section movably guided in the working direction, which is (mechanically) coupled to the flexible tractive force transmission means in order to convert a movement of the coupling section into a movement of the flexible tractive force transmission means, which causes a path-identical change in position of the functional elements in the working direction relative to the upper beam.

The adjustment device is a manual adjustment device by which the movement of the coupling section is effected via a mechanical application of force by an operator. To do so, the adjustment device comprises a tension-proof adjusting element, such as a strap or rope, having a handle (e.g., a grip). This tension-proof adjusting element is connected in the interior of the bending machine to the coupling section located there, wherein the tension-proof adjusting element extends from the interior of the bending machine through a body part of the bending machine to the handle, the handle being accessible from the exterior of the bending machine. Preferably, the coupling section is movable by increasing and decreasing the tractive force which the operator exerts on the tension-proof adjusting element via the handle. Preferably, the handle is magnetic or has a magnetic element so that the handle adheres to the body part of the bending machine, e.g., the front side of the upper beam, by magnetic force.

Thus, the bending machine according to the invention includes a safety system according to the invention.

Preferably, the bending machine includes one or more preferred embodiments of the safety system according to the invention. In other words, the bending machine can include the above features described in connection with preferred embodiments of the safety system according to the invention.

BRIEF DESCRIPTION OF THE SEVERAL VIEWS OF THE DRAWINGS

An exemplary embodiment of the invention is described in detail below with reference to the enclosed figures.

In the figures.

DETAILED DESCRIPTION OF THE INVENTION

Figure 1:
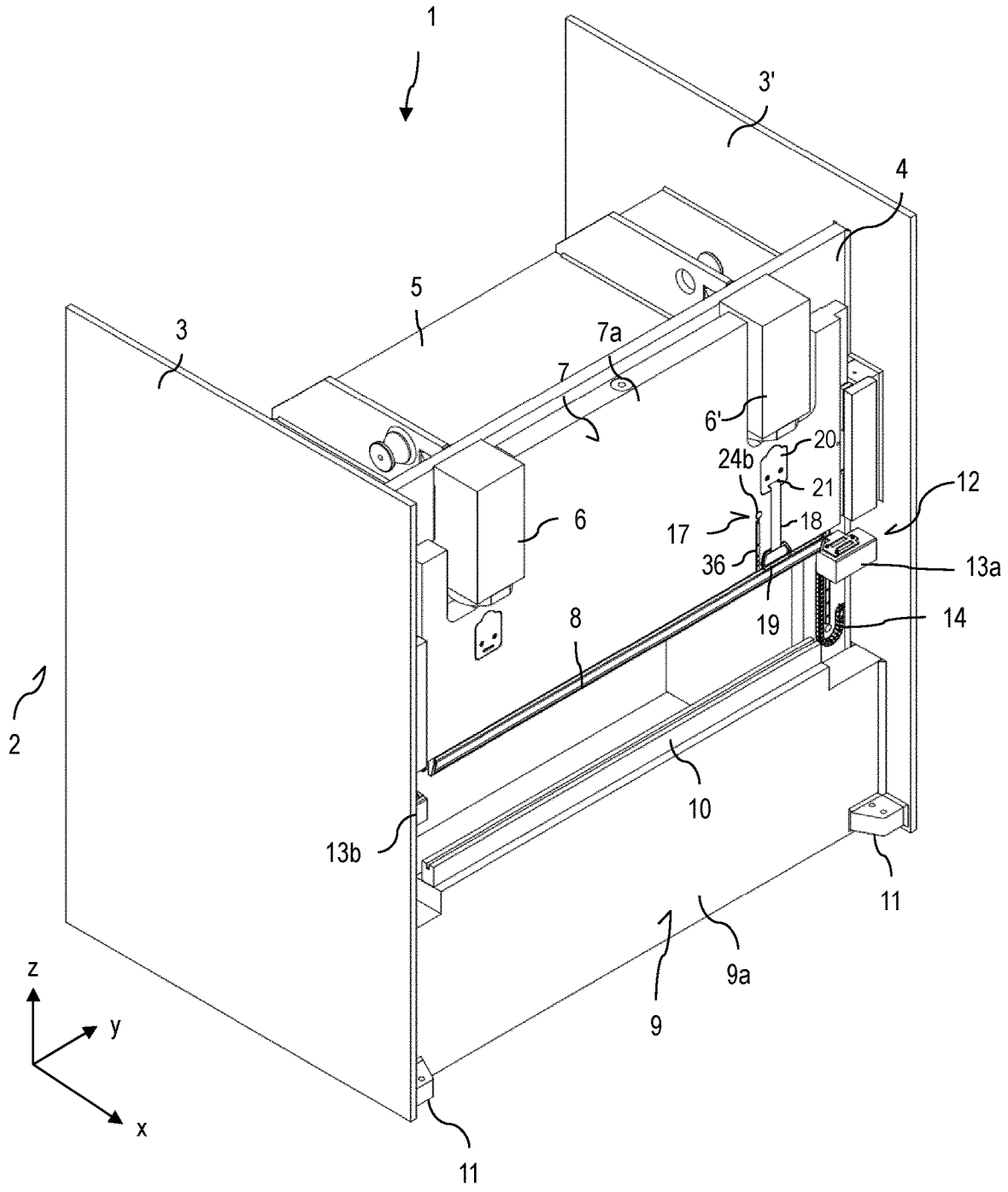
FIG. 1 shows a perspective view of an embodiment of a bending machine according to the invention in the form of a press brake.

In the following, an embodiment of the invention is described using a bending machine in the form of a press brake. A perspective view of this press brake is shown in FIG. 1, where it is designated by reference symbol 1. In FIG. 1 and also in the other FIGS. 2 to 5, a spatial coordinate system is shown to describe the directions of the bending machine. The x-direction corresponds to the depth direction of the bending machine and a workpiece to be bent is inserted into the bending machine via its front side in the direction opposite to the x-direction. In contrast, the y-direction is the width direction of the bending machine. Both directions are located in a horizontal plane. The z-direction is the vertical direction and corresponds to the height direction of the bending machine.

The bending machine 1 comprises a frame 2 including, among other things, two side stands 3, 3' and a frame plate 4. An upper beam 7 and a lower beam 9 are provided at the front side of the bending machine. The front side of the upper beam 7 is designated with reference symbol 7*a* and the front side of the lower beam 9 is designated with reference symbol 9*a*. On the upper edge of the lower beam 9 there is a tool table 10, on which lower tools are mounted during operation of the bending machine. In contrast, the upper beam 7 comprises a tool receptacle 8 for fastening corresponding upper tools. During operation of the bending machine, a sheet is inserted into the space between the upper beam 7 and the lower beam 9, and the upper beam 7 is then moved downwards so that the upper tools press into the lower tools, thereby deforming the sheet. To ensure a stable stand of the bending machine during a bending process, it is anchored to the floor in its corners using corresponding anchoring means 11.

A hydraulic actuator is used to move the upper beam 7, which is mostly located on the top of a reinforcement plate 5 that extends between the side stands 3 and 3'. In the illustration of FIG. 1, only the two hydraulic cylinders 6 and 6' of the actuator are visible, which are attached to the frame plate 4 and positioned in recesses of the upper beam 7. Corresponding cylinder rods are connected to the upper beam in this region and can cause the upper beam to move in the vertical height direction z.

In order to monitor the space between the upper beam and the lower beam and to detect the unintentional entry of objects into this region, a safety system 12 is provided on the bending machine. This safety system 12 comprises a first functional element, which in the embodiment described here is designed as a transmitter 13*a* for emitting light, for example in the non-visible infrared range, and a further functional element, which in the embodiment described here is designed as a receiver 13*b* that detects the light from the transmitter. The first functional element 13*a* or the transmitter is positioned at the right end of the upper beam 7, whereas the further functional element 13*b* or the receiver is positioned at the opposite left end of the upper beam 7. Alternatively, the further functional element 13*b* can be arranged at the right end of the upper beam 7 and the first functional element 13*a* at the left end of the upper beam. If an object or a human body part unintentionally enters between the upper beam 7 and the lower beam 9, this blocks or reduces the light radiation arriving at the receiver 13*b*, whereupon the movement of the upper beam 7 stops immediately. This prevents injuries to the human operator, for example when his hand enters between the upper beam and the lower beam.

The first functional element 13*a* and the further functional element 13*b* are connected to electrical cables via which they are controlled by means of a control device (not shown) and are also supplied with power. The cables are routed in corresponding energy chains 14 that extend downward from the transmitter or receiver.

The transmitter and receiver follow the vertical movement of the upper beam 7, wherein its relative height position with respect to the upper beam can be adjusted by an adjustment device 17, which is described in more detail below. Of this adjustment device, a tension-proof adjusting element 18 in the form of a band with a handle 19 in the form of a grip located thereon can be seen in FIG. 1. The tension-proof adjusting element extends into a passage 21 of a cover element 20 in the form of a cover plate on the front side 7*a* of the upper beam 7. In order to prevent the handle 19 from swerving when the upper beam is moved, it is preferably magnetic so that it adheres to the front side 7*a* of the upper beam 7 by magnetic force.

According to FIG. 1, a display means 36 in the form of a scale is further provided on the front side 7*a* of the upper beam 7, by means of which the height position of the transmitter and the receiver can be read as the position on the scale at the height of which a corresponding mark is located on the handle 19. Above the display means 36 there is an operating element 24*b* in the form of an operating knob flush with the front side 7*a* of the upper beam 7, which is part of the positioning element 24 described further below, which in the embodiment described here is designed as a bolt via which a locking of the adjustment device 17 is effected.

Figure 2:
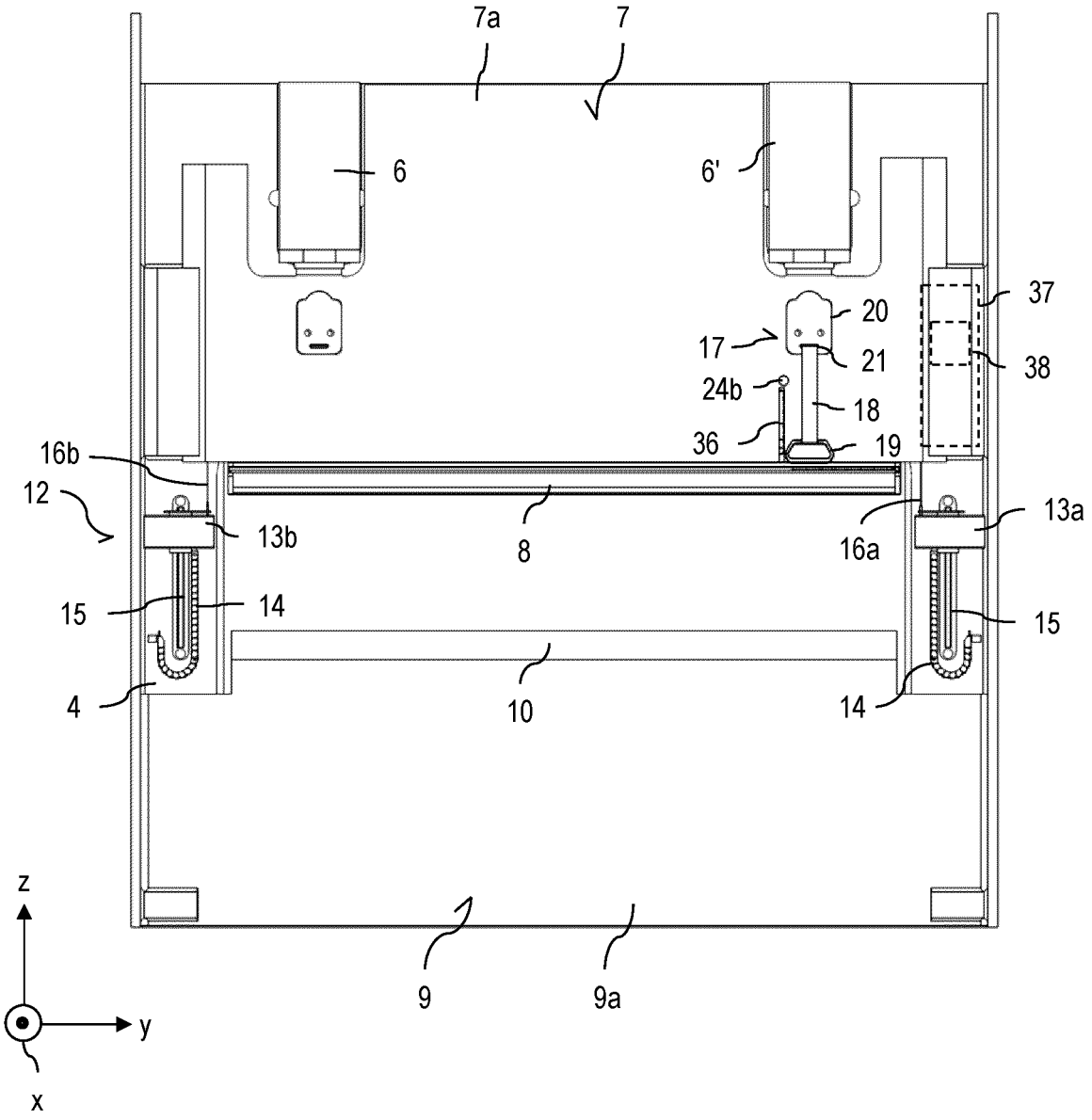
FIG. 2 shows a top view from the front of the bending machine of FIG. 1.

FIG. 2 shows a top view from the front of the bending machine of FIG. 1, from which the mounting of the transmitter and the receiver can be seen more easily. The transmitter, or the first functional element 13*a*, and the further functional element 13*b*, or the receiver, are connected to one another via a flexible tractive force transmission means 16 (see FIG. 3). The tractive force transmission means 16 comprises a first section 16*a*, which in the embodiment described herein is configured as a rope, and a further section 16*b*, which in the embodiment described herein is also configured as a rope. The ropes are, for example, thin wire ropes with a diameter between 0.5 and 5 mm. The exact structure of the tractive force transmission means 16 is described in more detail below with reference to FIG. 3. The rope forming the first section 16*a* is connected to the transmitter, whereas the rope forming the further section 16*b* is coupled to the receiver. These ropes are used to hold the transmitter and receiver in the current height position. The transmitter and receiver are further guided by respective vertically extending guides 15 on the frame plate 4.

In the embodiment described here, the adjustment device 17 is integrated in the upper beam 7. In a modified embodiment, it is also possible for the adjustment device 17 to be arranged to be laterally offset in the width direction y next to the upper beam at its right or left edge and mounted there to the frame plate 4. For example, the adjustment device can be located next to the right edge of the upper beam 7, where it can be covered by a cover 37, if required. This cover is only schematically indicated by a dashed rectangle in FIG. 2.

In the embodiment described here, an adjustment device that can be manually operated by an operator is used to adjust the height position of the transmitter and receiver. Nevertheless, the adjustment device can also include an actuator to operate it, if necessary. By way of example, a corresponding actuator is indicated schematically in FIG. 2 by a dashed square next to the right edge of the upper beam 7 and designated by reference symbol 38.

Figure 3:
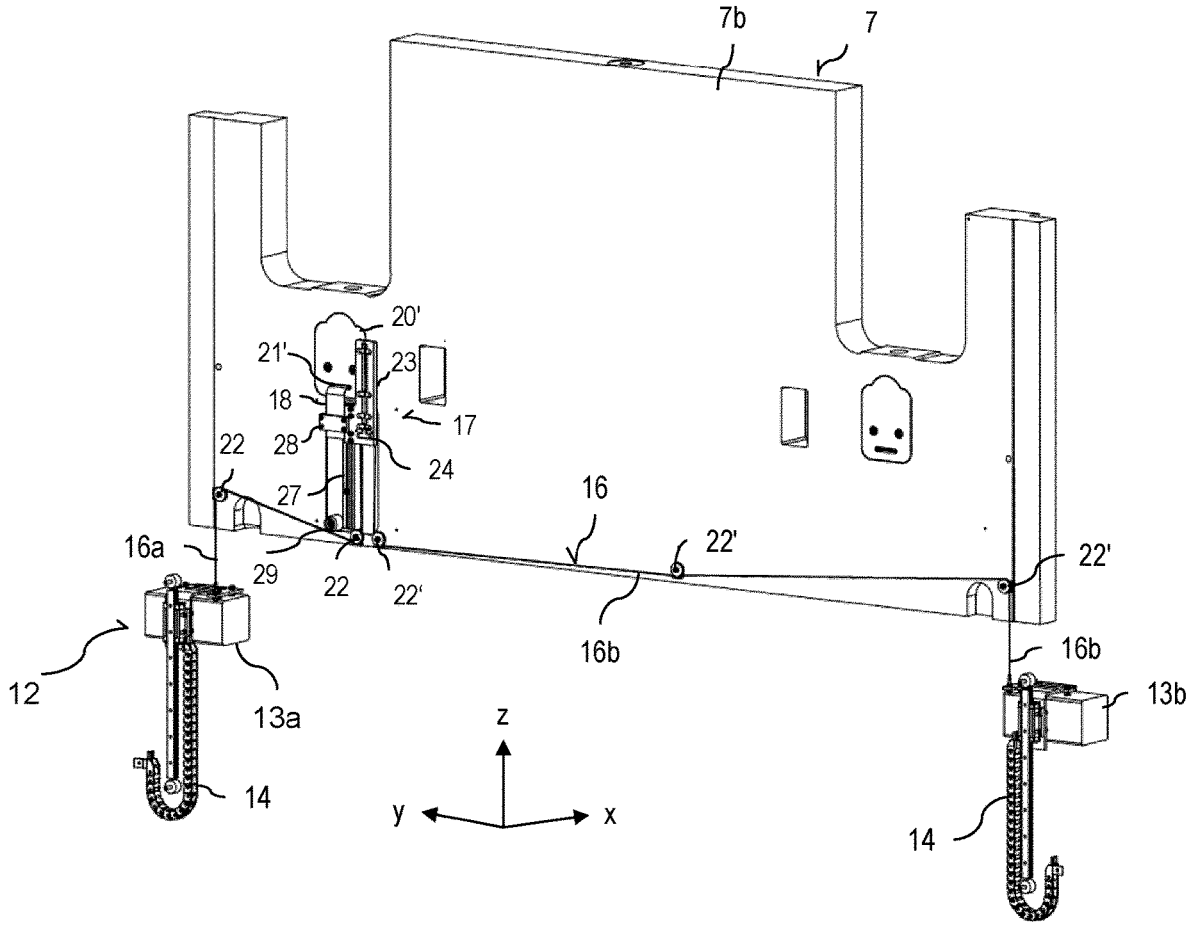
FIG. 3 shows a perspective view from behind the upper beam of the bending machine of FIG. 1 with the safety system installed there.

FIG. 3 shows a perspective view of the rear side 7*b* of the upper beam 7 with the adjustment device 17 integrated thereinto. FIG. 3 shows in particular the guide of the two ropes 16*a* and 16*b* of the tractive force transmission means 16. The rope 16*a* connected to the transmitter 13*a*, which is shorter than the rope 16*b*, runs via two deflection means 22 in the form of pulleys to a vertically displaceable coupling section 23, which is part of the adjustment device 17 and is guided in the vertical direction in a guide 27 (see FIG. 5). Similar to the first section/rope 16*a*, the further section/rope 16*b* runs over deflection means or deflection pulleys 22', wherein three deflection means are provided due to the greater rope length.

The two upper ends of the ropes are attached to the rear side of the coupling section 23. This can be seen in FIG. 5. There, it can be seen that the upper end of the rope 16*b* is connected to the coupling section 23 via an interface 30. The interface includes a fastening means 31*a* in the form of a screw, which attaches a counter fastening means 31*b* in the form of an eyelet attached to the upper end of the further section/rope 16*b* to the coupling section 23. Similarly, the upper end of the first section/rope 16*a* is attached to the coupling section 23 via a corresponding interface 30 of fastening means 31*a* and counter fastening means 31*b*.

By connecting the two cables to the common coupling section 23, a simultaneous vertical movement of the transmitter and receiver is easily achieved by means of a vertical movement of the coupling section 23. To allow an operator to move the coupling section 23, the tension-proof adjusting element 18 is connected to the coupling section 23 via an interface, which in the embodiment described here is configured as a clamping device 28. In this case, the clamping device 28 consists of two screwed clamping plates which hold the lower end of the tension-proof adjusting element 18 by clamping and are screwed to the coupling section 23. Below the clamping device 28 there is also a path limiting element 29, which is configured as a stop and by which the downward movement of the clamping device 28 and the coupling section 23 connected thereto is delimited.

According to FIG. 3, the tension-proof adjusting element 18 is guided above the clamping device 28 through a passage 21' of a cover element 20' in the form of a cover plate on the rear side 7*b* of the upper beam 7. The passage 21' corresponds to the corresponding passage 21 on the front side 7*a* of the upper beam 7. Between these passages, a corresponding opening is formed in the upper beam through which the tension-proof adjusting element 18 runs from the rear to the front side of the upper beam 7.

Figure 4:
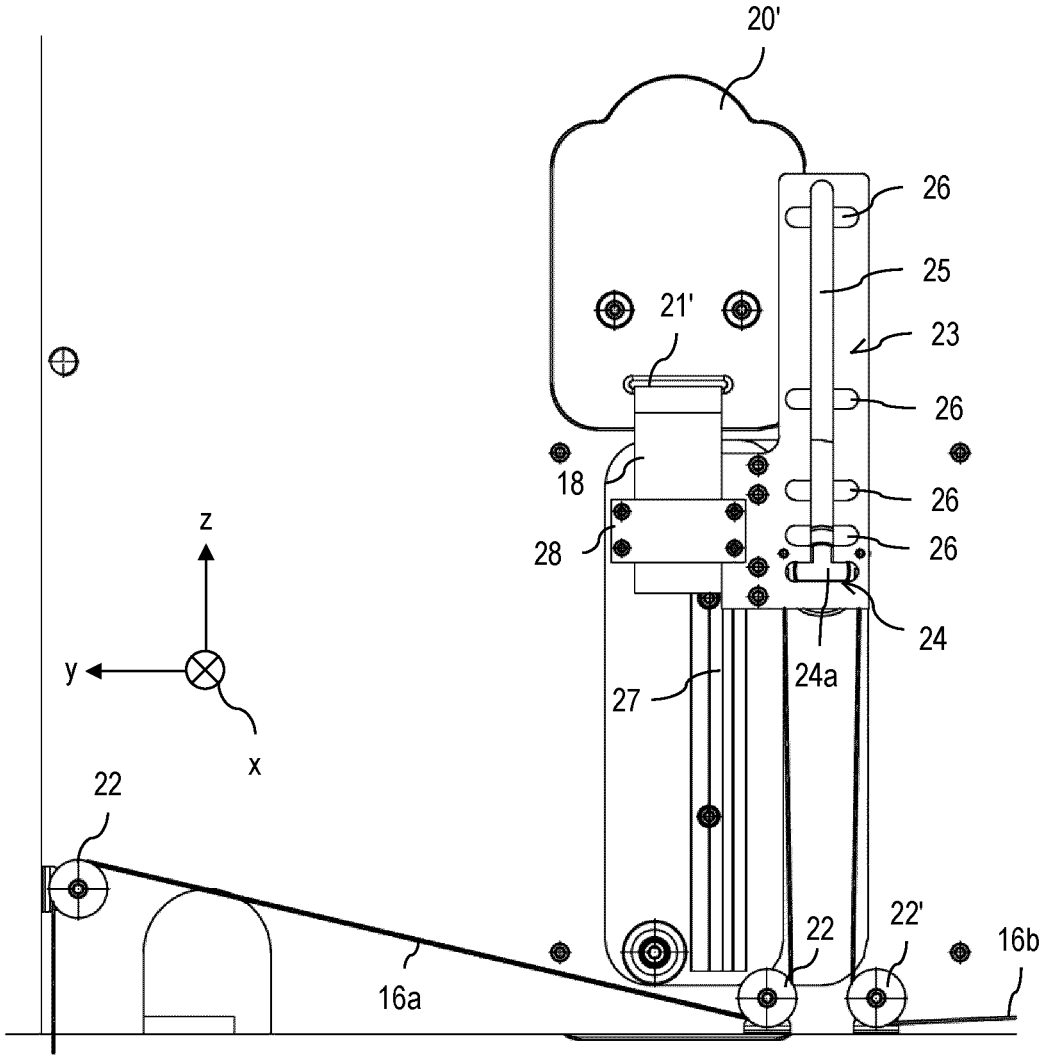
FIG. 4 shows a sectional plan view showing the adjustment device of FIG. 3 in detail.

The coupling section 23 can be locked in various vertical positions. For this purpose, the positioning element/bolt 24 is used, which interacts with a detent, which in the embodiment described here is formed by horizontally extending elongated holes 26 of the coupling section 23. The positioning element can be positioned in the horizontally extending elongated holes for locking, as explained in more detail below with reference to FIG. 4. This figure shows a detailed top view of the adjustment device of FIG. 3. In FIG. 4, the positioning element 24 can be seen in particular with its end located at the rear side 7*b* of the upper beam 7. This end is formed as a T-shaped section 24*a* with one horizontal leg and one vertical leg. In this regard, the horizontal leg of the T-shaped section 24*a* can be received in corresponding elongated holes 26 of the coupling section 23, thereby causing the coupling section to be locked in place and thereby adjusting a height position of the transmitter and receiver. The elongated holes extend perpendicular to an elongated guide opening 25 extending vertically, in which the positioning element 24 or the vertical leg of the T-shaped section 24*a* is guided in the vertical direction in the coupling section 23.

In the position of the coupling section 23 shown in FIG. 4, the horizontal leg of the T-shaped section 24*a* is located in the lowest of the total of five elongated holes 26, which corresponds to the highest vertical position of the transmitter and receiver. By positioning the horizontal leg of the T-shaped section in another elongated hole 26, the vertical position of the transmitter and receiver is lowered.

Figure 5:
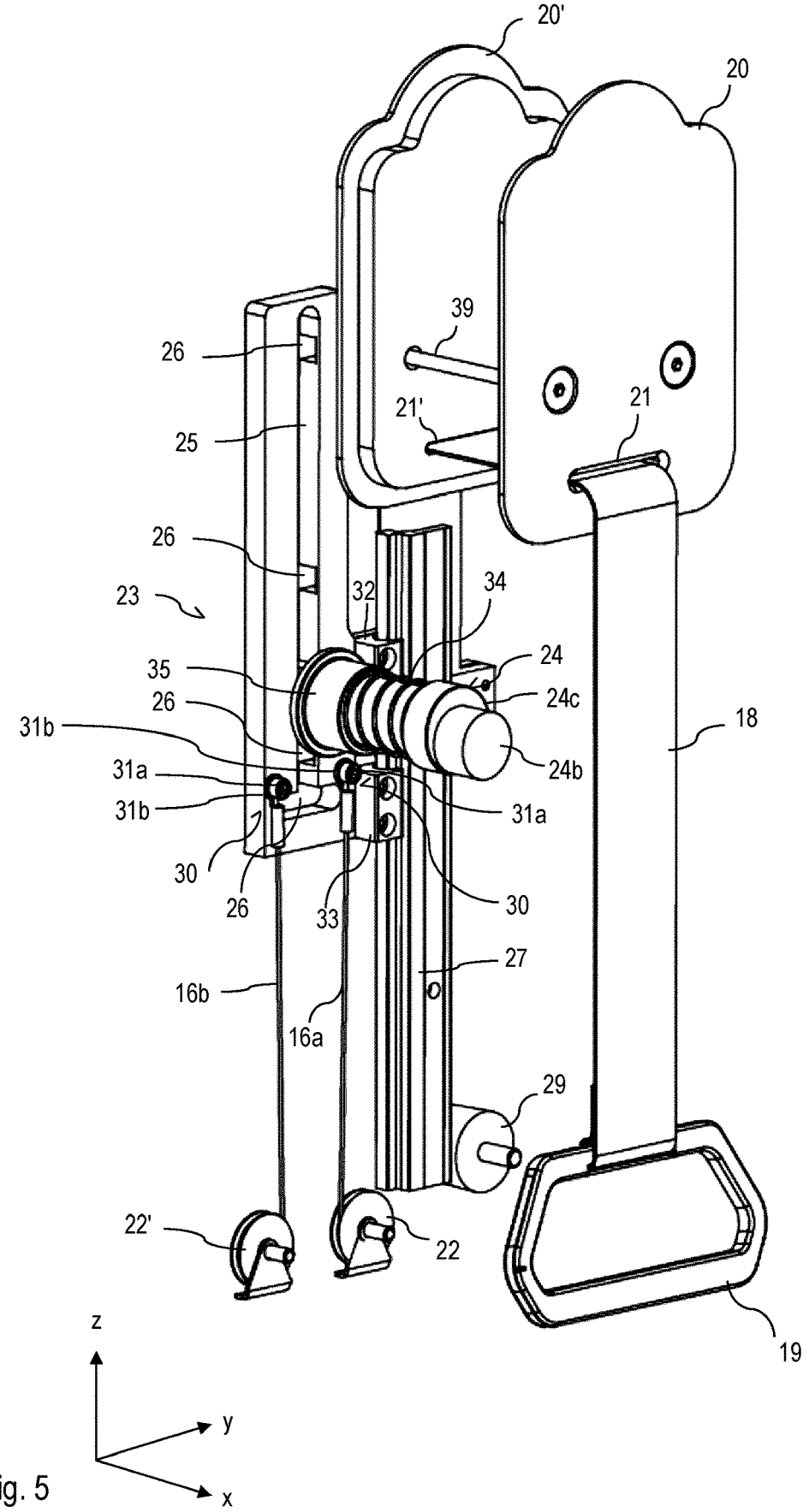
FIG. 5 shows a detailed perspective view, omitting the upper beam, illustrating the mechanism for locking the coupling section.

The locking and unlocking of the coupling section 23 by means of the positioning element 24 are explained in more detail below with reference to FIG. 5. This figure shows a detailed perspective view of the adjustment device 17 looking at the front side of the upper beam, wherein the upper beam has been omitted to show the components installed therein. In FIG. 5, the horizontal leg of the T-shaped section 24*a* is located in the third lowest of the five elongated holes 26, whereas in FIG. 4 it is received in the lowest elongated hole. FIG. 5 shows that the tension-proof adjusting element 18 extends through the upper beam between the two passages 21 and 21' of the cover elements 20, 20'. For this purpose, an opening corresponding to the passages 21, 21' is provided in the upper beam. In addition, the two cover elements 20 and 20' are connected to one another by connecting means via corresponding holes in the upper beam. In the embodiment described here, the connecting means are screw bolts by means of which the cover elements are screwed together, wherein one of these screw bolts can be seen in FIG. 5 and is designated with reference symbol 39.

From FIG. 5, it can further be seen that two slide elements 32 and 33 are provided at the rear side of the coupling section 23, which are guided along the guide 27, thereby allowing the coupling section 23 to slide vertically along the guide 27.

According to FIG. 5, the positioning element 24 used for locking has the operating element 24*b* mentioned above on the front side of the upper beam. The positioning element 24 extends through a corresponding opening in the upper beam and is biased toward the front side of the upper beam by an elastically designed return element 34 in the form of a coil spring. The return element 34 is located between a thickened cylindrical section 24*c* of the positioning element 24 and a guide bearing 35 in the form of a sleeve in which the positioning element is guided and which is arranged adjacent to the coupling section 23 in the upper beam.

By an operator pressing on the operating element 24*b* of the positioning element 24, the positioning element 24 is pressed into the upper beam 7 against the elastic force of the return element 34. As a result, the horizontal leg of the T-shaped section 24*a* moves out of the corresponding elongated hole 26. In this case, the thickness of the horizontal leg is less than the thickness of the vertical leg of the T-shaped section 24*a*. As soon as the horizontal leg is outside the elongated hole 26, the movement of the coupling section 23 is released. The movement of the coupling section can be controlled by the operator by pulling on the tension-proof adjusting element 18 or releasing the tractive force on the tension-proof adjusting element 18 via the handle 19.

In the following, the operating action of the operator for simultaneous height adjustment of the first functional element/transmitter 13*a* and the further functional element/receiver 13*b* is explained. When the operator determines that, for example, due to the installation of new upper or lower tools, the transmitter and receiver are to be arranged in a new height position, he grips the tension-proof adjusting element 18 via the handle 19 and simultaneously presses the operating element 24*b* of the positioning element 24, thereby releasing the movement of the coupling section 23. First, the operator holds the coupling section 23 in the current height position by pulling on the tension-proof adjusting element 18.

To lower the transmitter and receiver, the operator triggers the vertical downward movement of the coupling section by reducing his pull on the tension-proof adjusting element 18 until the coupling section is in the desired vertical position, which correlates with a corresponding desired height position of the of the functional elements 13*a* and 13*b*. Similarly, the operator can initiate a lifting of the transmitter and receiver by pulling on the tension-proof adjusting element 18 and an associated upward vertical movement of the coupling section 23, provided that the horizontal leg of the T-shaped section 24*a* is not in the lowest elongated hole.

Once the desired height position is reached, this is indicated to the operator by correlation of the marking on the handle 19 with the corresponding height indicated on the display means 36. The horizontal leg of the T-shaped section 24*a* is then at the level of another elongated hole. The operator then releases the operating element 24*b*. Thereupon, the horizontal leg of the T-shaped section 24*a* slides into the new elongated hole and causes the coupling section 23 to be locked in place.

The embodiment of the invention described in the foregoing provides a number of advantages. In particular, simultaneous height adjustment of the transmitter and receiver is provided in a simple manner by a movable coupling section connected to both the transmitter and receiver of a safety system via flexible tractive force transmission means. Through a corresponding design or arrangement of an adjustment device, for example in the form of a coupling section on the rear side of the upper beam in combination with a tension-proof adjusting element on the front side of the upper beam and an operating element flush with the front side, interference contours or pinch points on the front side of the upper beam are prevented.

The invention claimed is:

1. A bending machine or a press brake, comprising:

an upper beam and a lower beam, wherein the upper beam is movable in a working direction of the bending machine or the press brake relative to the lower beam, in order to form a workpiece configured to be inserted between the upper beam and the lower beam via a front side of the bending machine or the press brake, by bending along a bending line, which extends in a width direction of the bending machine or the press brake, a safety system comprising a first optical safety element and a further optical safety element configured to monitor a safety area between the first optical safety element and the further optical safety element and between the upper beam and the lower beam, and wherein the safety system is configured and arranged to follow the movement of the upper beam in the working direction, wherein the first optical safety element and the further optical safety element are arranged mechanically connected to one another via a flexible tractive force transmission means and an adjustment device configured to change the position of the functional elements, wherein the adjustment device further comprises a coupling section configured and arranged to be movably guided in the working direction, coupled to the flexible tractive force transmission means in order to convert a movement of the coupling section into a movement of the flexible tractive force transmission means, which causes a path identical change in position of the optical safety elements in the working direction relative to the upper beam, wherein the adjustment device is a manual adjustment device configured such that movement of the coupling section is effected via a mechanical application of force by an operator, where the adjustment device comprises a tension-proof adjusting element comprising a handle which is connected in the interior of the bending machine or the press brake to the coupling section located there, and wherein the tension-proof adjusting element is arranged to extend from the interior of the bonding machine through a body part of the bending machine to the exterior of the bonding machine connecting to the handle, the handle being accessible from the exterior of the bending machine or the press brake, and wherein the flexible tractive force transmission means is configured and arranged to be guided on the rear side of the upper beam facing away from the front side of the bending machine or the press brake.

2. The bending machine or the press brake according to claim 1, wherein the coupling section and the flexible tractive force transmission means are arranged such that a change in position of the first optical safety element and the further optical safety element in the working direction relative to the upper beam is a linear displacement of the first optical safety element and the further optical safety element along the working direction.

3. Tue bending machine or the press brake according to claim 1, wherein the flexible tractive force transmission means further comprises one or more sections, wherein a first section is configured to connect the coupling section to the first optical safety element and another section from the first section is configured to connect to the coupling section to the further optical safety element.

4. The bending machine or the press brake according to claim 1 wherein for guiding the flexible tractive force transmission means, one or more deflection means are configured and arranged on the rear side of the upper beam.

5. The bending machine or the press brake according to claim 1, wherein the adjustment device is arranged on the upper beam, wherein the coupling section is arranged on the rear side of the upper beam, or the adjustment device is arranged to be laterally offset in the width direction next to the upper beam, and wherein the adjustment device is covered by a cover.

6. The bending machine or the press brake according claim 1, wherein the coupling section is linearly movable in the working direction of the bending machine or the press brake, wherein the linear movement of the coupling section is configured to displace one end of the flexible tractive force transmission means connected to the first optical safety element offset by the same distance in the working direction as another end of the tractive force transmission means connected to the further optical safety element.

7. The bending machine or the press brake according to claim 1, wherein the coupling section is configured to be movable by increasing and decreasing the tractive force which the operator exerts on the tension-proof adjusting element via the handle.

8. The bending machine or the press brake according to claim 7, wherein a tension-proof adjusting element is connected on the rear side of the upper beam to the coupling section located there, wherein the tension-proof adjusting element extends from the rear side of the upper beam through the upper beam and then along the front side of the upper beam opposite the rear side to the handle, wherein the coupling section is movable by increasing and decreasing the tractive force which the operator exerts on the tension-proof adjusting element via the handle.

9. The bending machine or the press brake according to claim 7, wherein the adjustment device comprises a locking means by which the operator is configured and arranged to lock the coupling section in a plurality of different positions, wherein the locking means is configured and arranged to be released from a locked position by the operator and subsequently locked in a new position by the operator after movement of the coupling section.

10. The bending machine or the press brake according to claim 9, wherein the locking means comprises a positioning element operable via the front side of the upper beam, for locking in various defined locking positions of the coupling section, wherein the positioning element is biased into a locking position via a return element.

11. The bending machine or the press brake according to claim 1, further comprising a display means configured and arranged to visualize a position of the first optical safety element and the further optical safety element in the working direction.

* * * * *